US011002426B2

(12) United States Patent
Liu

(10) Patent No.: US 11,002,426 B2
(45) Date of Patent: May 11, 2021

(54) LIGHTING APPARATUS

(71) Applicant: OPPLE LIGHTING CO., LTD., Shanghai (CN)

(72) Inventor: Chaobo Liu, Shanghai (CN)

(73) Assignee: Opple Lighting Co., Ltd., Shanghai (CN)

( * ) Notice: Subject to any disclaimer, the term of this patent is extended or adjusted under 35 U.S.C. 154(b) by 111 days.

(21) Appl. No.: 16/386,128

(22) Filed: Apr. 16, 2019

(65) Prior Publication Data

US 2019/0242552 A1 Aug. 8, 2019

Related U.S. Application Data

(63) Continuation of application No. PCT/CN2017/106583, filed on Oct. 17, 2017.

(30) Foreign Application Priority Data

Oct. 26, 2016 (CN) ..... 201610948477.1
Oct. 26, 2016 (CN) ..... 201621172757.X
(Continued)

(51) Int. Cl.
*F21V 7/04* (2006.01)
*F21V 29/70* (2015.01)
(Continued)

(52) U.S. Cl.
CPC ..... *F21V 7/041* (2013.01); *F21V 7/0025* (2013.01); *F21V 15/01* (2013.01); *F21V 23/006* (2013.01);
(Continued)

(58) Field of Classification Search
CPC ..... F21V 7/041; F21V 7/0025; F21V 7/24; F21V 29/503; F21V 29/508; F21V 29/70;
(Continued)

(56) References Cited

U.S. PATENT DOCUMENTS 9,995,439 B1 * 6/2018 Shum ..... F21V 17/105
2013/0077320 A1 * 3/2013 Duan ..... F21V 7/0091 362/297
2017/0082265 A1 * 3/2017 Xie ..... F21V 23/005

FOREIGN PATENT DOCUMENTS

CN 102748706 A 10/2012
CN 205402432 U 7/2016
(Continued)

OTHER PUBLICATIONS

International Search Report (including English translation) and Written Opinion issued in PCT/CN2017/106583, dated Feb. 24, 2018, 11 pages.

*Primary Examiner* — Andrew J Coughlin
*Assistant Examiner* — Jessica M Apenteng
(74) *Attorney, Agent, or Firm* — Arch & Lake LLP

(57) ABSTRACT

The present disclosure discloses a lighting apparatus, including a lamp body, an optical element connected with the lamp body, a driving power source assembly, a light source assembly and a reflecting device configured to provide a secondary light distribution for the light source assembly which are received in the lamp body; the reflecting device is provided with a light inlet, a light outlet and a reflecting wall located between the light inlet and the light outlet; the reflecting wall is transparent, and includes an internal surface and an external surface; the internal surface includes a plurality of saw-tooth structures, each of the saw-tooth structures includes a first refracting surface and a second refracting surface intersected with each other, two ends of each of the saw-tooth structures extend towards the light inlet and the light outlet; and the light source assembly is disposed at the light inlet of the reflecting device.

18 Claims, 14 Drawing Sheets

(30) Foreign Application Priority Data

| | | |
|---|---|---|
| Oct. 26, 2016 | (CN) | 201720157275.5 |
| Jan. 23, 2017 | (CN) | 201710057123.2 |
| Jan. 23, 2017 | (CN) | 201720090222.6 |
| Feb. 21, 2017 | (CN) | 201710093145.4 |
| May 26, 2017 | (CN) | 201710385278.9 |
| May 26, 2017 | (CN) | 201720604819.8 |

(51) Int. Cl.

| | |
|---|---|
| ***F21V 29/503*** | (2015.01) |
| ***F21V 23/00*** | (2015.01) |
| ***F21V 15/01*** | (2006.01) |
| ***F21V 29/508*** | (2015.01) |
| ***F21V 7/00*** | (2006.01) |
| ***F21V 7/24*** | (2018.01) |
| ***F21Y 115/10*** | (2016.01) |
| ***F21V 17/16*** | (2006.01) |

(52) U.S. Cl.
CPC ..... *F21V 29/503* (2015.01); *F21V 29/508* (2015.01); *F21V 29/70* (2015.01); *F21V 7/24* (2018.02); *F21V 17/16* (2013.01); *F21Y 2115/10* (2016.08)

(58) Field of Classification Search
CPC ..... F21V 15/01; F21V 23/006; F21V 17/16; F21Y 2115/10
USPC ..... 362/294
See application file for complete search history.

(56) References Cited

FOREIGN PATENT DOCUMENTS

| | | | |
|---|---|---|---|
| CN | 106439733 | A | 2/2017 |
| CN | 205956947 | U | 2/2017 |
| CN | 107036051 | A | 8/2017 |
| WO | 2017032493 | A1 | 3/2017 |

* cited by examiner

LIGHTING APPARATUS

CROSS-REFERENCE TO RELATED APPLICATIONS

This application is based upon and claims the priority of PCT patent application No. PCT/CN2017/106583 filed on Oct. 17, 2017 which claims the priority of Chinese Patent Application No. 201610948477.1 filed on Oct. 26, 2016, Chinese Patent Application No. 201710057123.2 filed on Jan. 23, 2017, Chinese Patent Application No. 201710093145.4 filed on Feb. 21, 2017, Chinese Patent Application No. 201720157275.5 filed on Oct. 26, 2016, Chinese Patent Application No. 201710385278.9 filed on May 26, 2017, Chinese Patent Application No. 201621172757.X filed on Oct. 26, 2016, Chinese Patent Application No. 201720090222.6 filed on Jan. 23, 2017 and Chinese Patent Application No. 201720604819.8 filed on May 26, 2017, the entire content of all of which is hereby incorporated by reference herein for all purposes.

TECHNICAL FIELD

The present disclosure relates to the field of lighting technology, and particularly to a lighting apparatus.

BACKGROUND

Electroplated reflectors are widely applied in commercially used lamps, for example, in illumination lamps such as downlight lamp, spotlight lamp, ceiling lamp and outdoor lamp. The electroplated reflector mainly functions as providing a secondary light distribution for light emitted from a light source. The electroplated reflector generally includes a reflecting surface plated with a layer of metallic film. However, a coating material typically has a relatively higher absorptivity to light, for example, a loss ratio resulted by an electroplated argentum (Ag) film is 5%, a loss ratio resulted by an electroplated aurum (Au) film is 9%, and a loss ratio resulted by an electroplated aluminum (Al) film even reaches up to 12%, which leads to a poor luminous efficiency of the lamp using an electroplated reflector.

SUMMARY

The present disclosure provides a lighting apparatus and a method of manufacturing a lighting apparatus.

According to one aspect, the present disclosure provides a lighting apparatus. The lighting apparatus may include a lamp body, an optical element connected with the lamp body, a light source assembly received in the lamp body, a reflecting device received in the lamp body and configured to provide a secondary light distribution for the light source assembly, and a driving power source assembly received in the lamp body and electrically connected with the light source assembly; where the reflecting device is provided with a light inlet, a light outlet and a reflecting wall located between the light inlet and the light outlet; the reflecting wall is transparent, and the reflecting wall includes an internal surface and an external surface.

The internal surface of the lighting apparatus may include a plurality of saw-tooth structures arranged continuously; each of the saw-tooth structures includes a first refracting surface and a second refracting surface intersected with each other; two ends of each of the saw-tooth structures extend towards the light inlet and the light outlet; and the light source assembly may be disposed at the light inlet of the reflecting device.

According to a second aspect, a method of manufacturing a lighting apparatus is provided. The method may include providing a lamp body; connecting an optical element the lamp body; receiving a light source assembly in the lamp body; receiving a reflecting device in the lamp body, where the reflecting device is configured to provide: a light distribution for the light source assembly, and a driving power source assembly received in the lamp body and electrically connected with the light source assembly.

The method may also include providing the reflecting device with a light inlet, a light outlet and a reflecting wall located between the light inlet and the light outlet, where the reflecting wall is transparent, and the reflecting wall comprises an internal surface and an external surface, where the internal surface may include a plurality of saw-tooth structures arranged continuously, each of the saw-tooth structures may include a first refracting surface and a second refracting surface intersected with each other, and two ends of each of the saw-tooth structures extend towards the light inlet and the light outlet; and disposing the light source assembly at the light inlet of the reflecting device.

It is to be understood that both the foregoing general description and the following detailed description are exemplary and explanatory only and are not restrictive of the present disclosure.

BRIEF DESCRIPTION OF THE DRAWINGS

The accompanying drawings described herein are provided for further understanding of the present disclosure, and constitute a part of the present disclosure. Examples of the present disclosure and descriptions thereof are used for the purpose of explaining the present disclosure, and are not to be construed as any improper limitation to the present disclosure. In the accompanying drawings.

DETAILED DESCRIPTION

Figure 1:
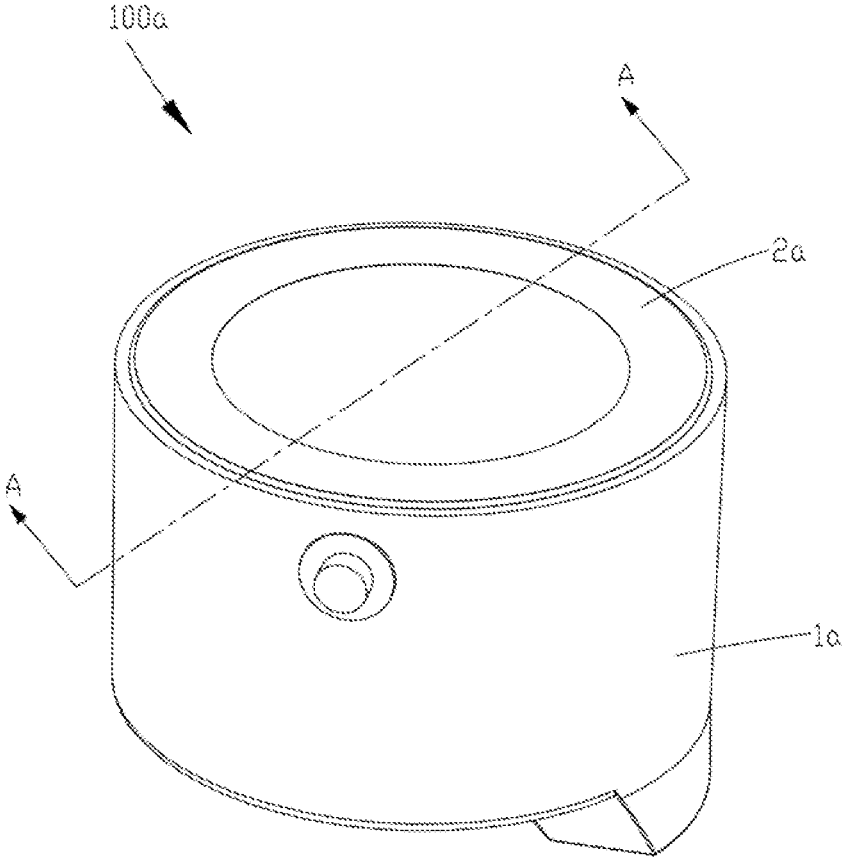
FIG. 1 is a perspective view of a lighting apparatus provided by a first example of the present disclosure.

In order to make objects, technical solutions and advantages of the present disclosure more apparent, the technical solutions of the examples will be described in a clear and complete way in connection with specific examples and corresponding drawings of the present disclosure. Apparently, the described examples are just a part but not all of the examples of the present disclosure. Based on the examples in the present disclosure, those ordinary skilled in the art can obtain all other example(s), without any inventive work, which all should be within the scope of the present disclosure.

The terminology used in the present disclosure is for the purpose of describing exemplary examples only and is not intended to limit the present disclosure. As used in the present disclosure and the appended claims, the singular forms "a," "an" and "the" are intended to include the plural forms as well, unless the context clearly indicates otherwise. It shall also be understood that the terms "or" and "and/or" used herein are intended to signify and include any or all possible combinations of one or more of the associated listed items, unless the context clearly indicates otherwise.

It shall be understood that, although the terms "first," "second," "third," and the like may be used herein to describe various information, the information should not be limited by these terms. These terms are only used to distinguish one category of information from another. For example, without departing from the scope of the present disclosure, first information may be termed as second information; and similarly, second information may also be termed as first information. As used herein, the term "if" may be understood to mean "when" or "upon" or "in response to" depending on the context.

The First Example

As illustrated in FIGS. 1-4, an example of the present disclosure provides a lighting apparatus 100*a*, which is a spotlight lamp. Particularly, the lighting apparatus 100*a* includes a lamp body 1*a*, an optical element 2*a* connected with the lamp body 1*a*, a heat sink 6*a* received in the lamp body 1*a*, a driving power source assembly 4*a* received in the heat sink 6*a*, a light source assembly 3*a* received in the heat sink 6*a*, and a reflecting device 5*a* configured to provide a secondary light distribution for the light source assembly 3*a* and received in the heat sink 6*a*. The light source assembly 3*a* is disposed at an end of the reflecting device 5*a*. It should be explained that, the reflecting device 5*a* is in an annular shape and is transparent; a part of light emitted from the light source assembly 3*a* directly exits through the optical element 2*a*, and another part of the light is reflected by the reflecting device 5*a* and then exits through the optical element 2*a*.

Hereinafter, various components and connecting relationships among components in the lighting apparatus 100*a* provided by the example of the present disclosure will be described in more details.

Figure 2:
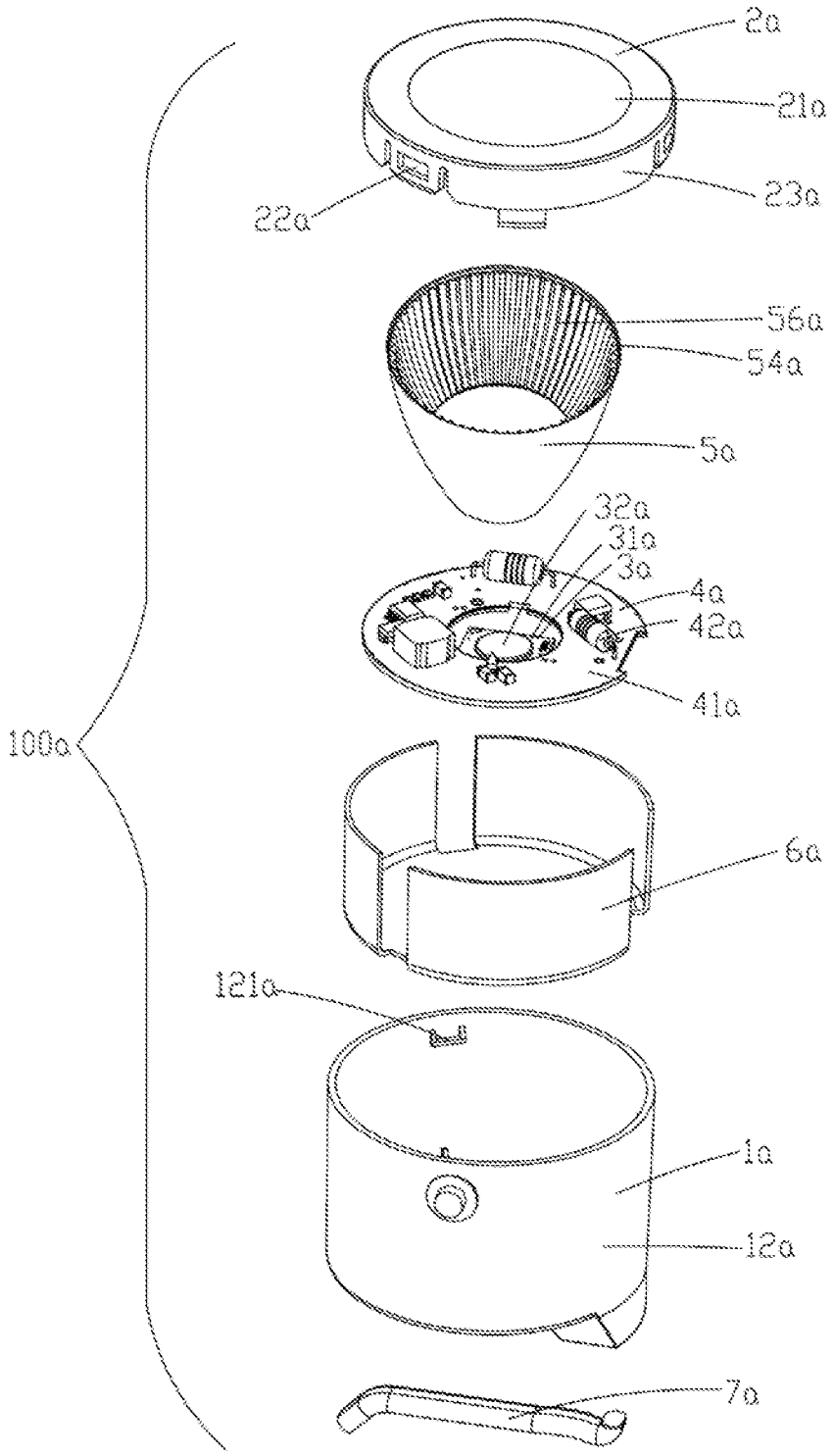
FIG. 2 is an exploded view of the lighting apparatus in FIG. 1.

As illustrated in FIG. 2, the lamp body 1*a* is in a cylindrical shape; the lamp body 1 is connected with the optical element 2*a* to form a receiving chamber 10*a*; the light source assembly 3*a*, the driving power source assembly 4*a*, the reflecting device 5*a* and the heat sink 6*a* are all received in the receiving chamber 10*a*. Particularly, the lamp body 1*a* includes a bottom wall 11*a* and a side wall 12*a*, an internal surface of the side wall 12*a* is provided with a plurality of protrusions 121*a* which may also be grooves in other alternative examples. The lamp body 1*a* may be made of a thermal-conductive metallic material such as Al, and may also be integrally formed from thermal-conductive plastic or plastic material overlaid with Al. As a result, the lamp body 1*a* has high thermal conductivity. When the light source assembly 3*a* located inside the receiving chamber 10*a* generates heat, the heat may be quickly dissipated through the lamp body 1*a*, so as to prevent from an excessively high temperature inside the receiving chamber 10*a* which may affect a service quality and a service life of the light source assembly 3*a*.

Figure 3:
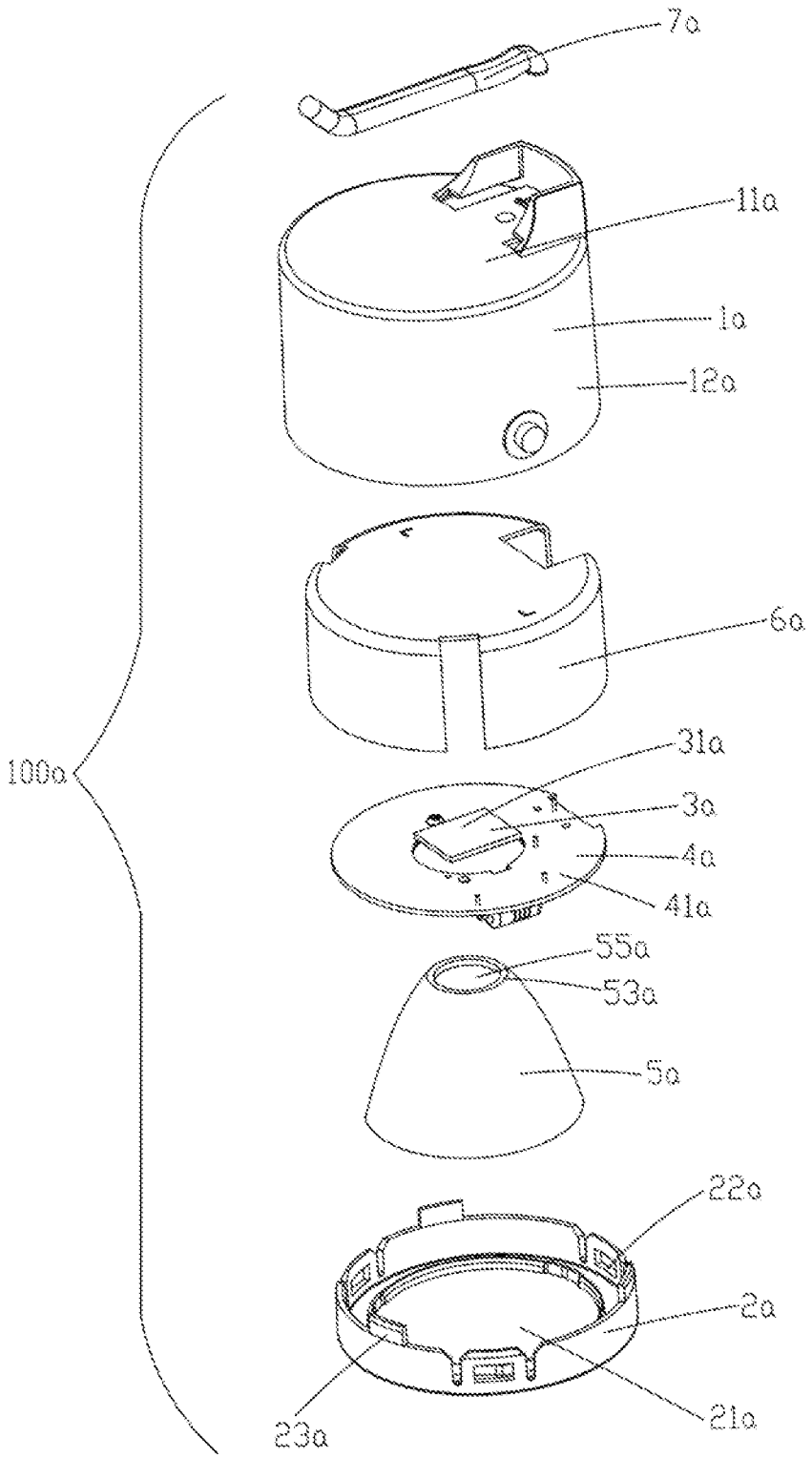
FIG. 3 is an exploded view of the lighting apparatus in FIG. 1 from another viewing angle.
Figure 4:
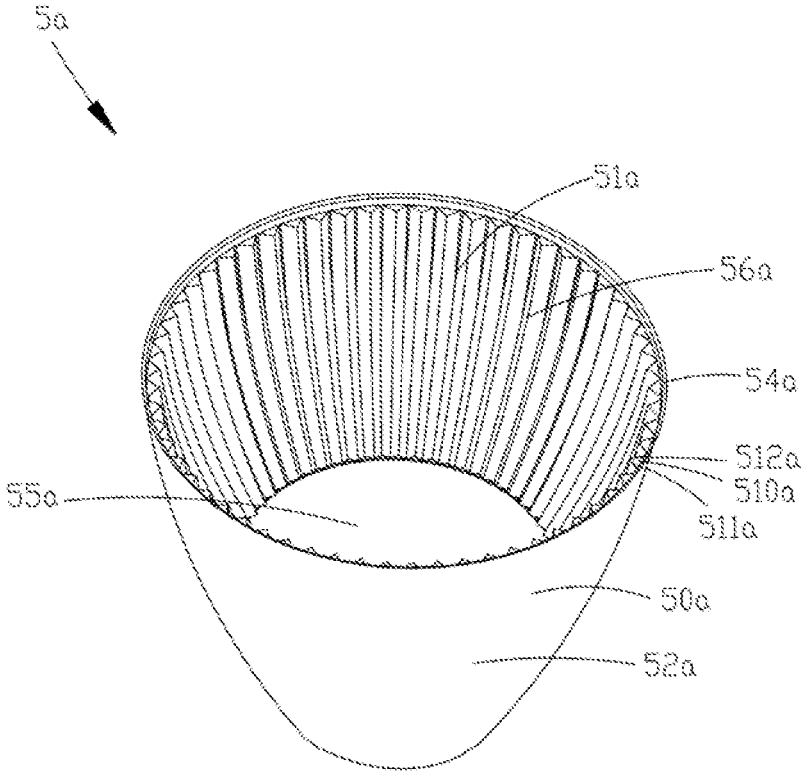
FIG. 4 is a perspective view of a reflecting device in the lighting apparatus provided by the first example of the present disclosure.
Figure 5:
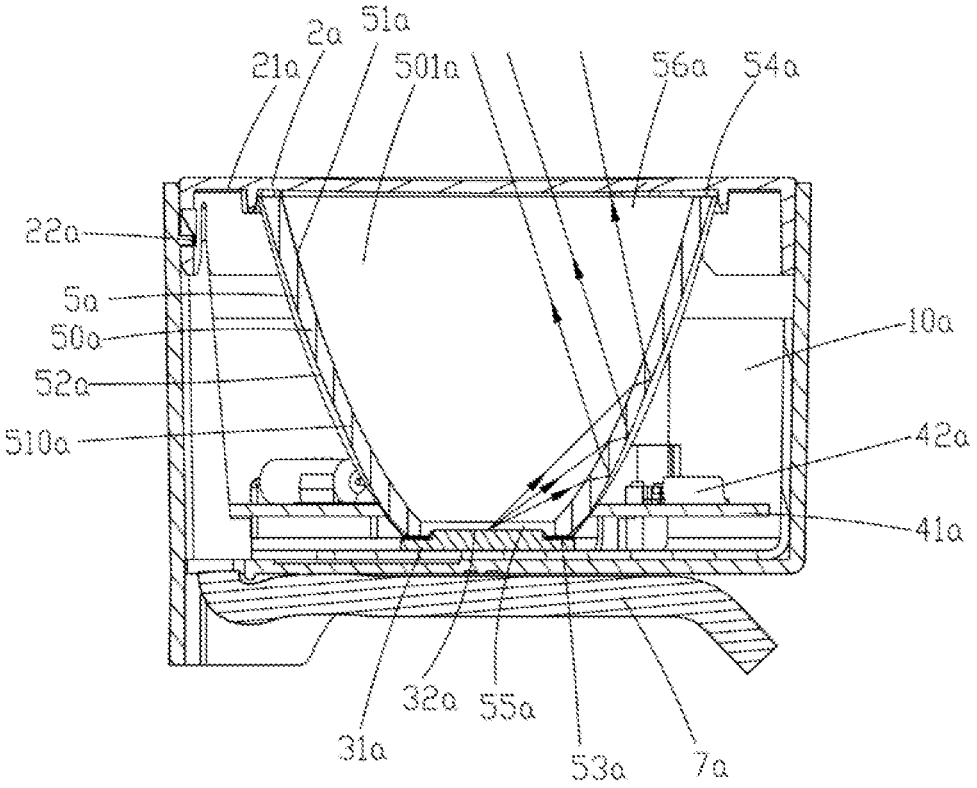
FIG. 5 is a sectional view taken along A-A line in FIG. 1.

As illustrated in FIG. 2, FIG. 3 and FIG. 5, the optical element 2*a* is in a circular shape, and is connected with the lamp body 1*a* in a snap-fit manner. In the present example, the optical element 2*a* plays a role of brightness balance. Particularly, the optical element 2*a* includes a circular-shaped top wall 21*a*, and a plurality of clamping structures 22*a* and abutting structures 23*a* which are extending downwards from the top wall 21*a*. The protrusion 121*a* is received in the clamping structure 22*a*, so as to achieve a connection between the lamp body 1*a* and the optical element 2*a* in a snap-fit manner. The abutting structure 23*a* is configured to press against the heat sink 6*a* inside the lamp body 1*a*.

The heat sink 6*a* is in a housing shape, the light source assembly 3*a* and the driving power source assembly 4*a* both are received in the heat sink 6*a*. In the present example, the heat sink 6*a* is disposed between the lamp body 1*a* and the optical element 2*a* in a manner of abutting against the lamp body 1*a* and the optical element 2*a*. Particularly, a lower surface of the heat sink 6*a* is attached onto the bottom wall 11*a* of the lamp body 1*a*, and an upper end face of the heat sink 6*a* is abutted against an end face of the abutting structure 23*a* of the optical element 2*a*. The heat sink 6*a* may be made of a thermal-conductive metallic material such as Al, and may also be integrally formed from a plastic material overlaid with Al.

As illustrated in FIG. 2 and FIG. 3, the light source assembly 3*a* includes a light source plate 31*a* and a light-emitting unit 32*a* located on the light source plate 31*a*. Particularly, the light-emitting unit 32*a* is disposed at the middle part of the light source plate 31*a*, that is, disposed at the middle of an opened side of the reflecting device 5*a*. In the present example, the light-emitting unit 32*a* is a light-emitting diode (LED) light source. The number of the light-emitting unit 32*a* may be one or plural. When a plurality of light-emitting units 32 is provided, it needs to intensely dispose these light-emitting units 32 at a central area of a light inlet 55*a* of the reflecting device 5*a*. In the present example, the light source plate 31*a* is fixed inside the heat sink 6*a*, and is positioned through a positioning surface (not labeled) disposed on the lamp body 1*a*.

The driving power source assembly 4*a* includes an annular-shaped power source plate 41*a* and a LED driving power source 42*a* located at one side of the light source plate 41*a*.

In the present example, the power source plate 41*a* is located at an external side of the light source plate 31*a* and is located above the light source plate 31*a*. The LED driving power source 42*a* includes a plurality of components, including but not limited to a LED driving controller chip, a rectification chip, a resistor, a capacitor, a fuse wire, a coil and the like. The lighting apparatus 100*a* of the present example further includes a power source line 7*a*, the power source line 7*a* extends into the lamp body 1*a* and is welded to the power source plate 41*a*; the power source plate 41*a* transmits an external power to the LED driving power source 42*a*, and the LED driving power source 42*a* further drives the LED light source 32*a* to emit light.

In other alternative examples, the LED light source 32*a* and the LED driving power source 42*a* may also be integrated onto a same substrate (not illustrated) by using Through Hole Technology (THT) or Surface Mount Technology (SMT). The LED driving power source 42*a* may be partly bonded onto one side of the substrate provided with the LED light source 32*a*, and the other side of the substrate is provided with a plug-in type driving power source component to reduce the cost; the LED driving power source 42*a* may also be completely bonded onto the side of the substrate provided with the LED light source 32*a*; or the LED driving power source 42*a* is completely formed as a plug-in part on the other side (not provided with the LED light source 32*a*) of the substrate; or the LED driving power source 42*a* is partly bonded onto the other side and partly formed as a plug-in part on the other side.

As illustrated in FIGS. 2-5, the reflecting device 5*a* uses a lens as the reflecting wall 50*a*, which is in an annular shape and has uniform thickness. The reflecting wall 50*a* encloses and delimits an optical space 501*a*. Such structure is similar to a reflection cup but uses a transparent material, which makes the structure visible from outside and is easy to replace the reflection cup. Particularly, the reflecting wall 50*a* has an internal surface 51*a*, an external surface 52*a*, a first end face 53*a* and a second end face 54*a*; the light inlet 55*a* of the reflecting device 5*a* is located at the first end face 53*a*; the light outlet 56*a* is located at the second end face 54*a*, that is, the reflecting wall 50*a* is located between the light inlet 55*a* and the light outlet 56*a*. The light inlet 55*a* and the light outlet 56*a* are communicated with the optical space 501*a*; the light source plate 31*a* closes the light inlet 55*a*; and a diameter of the light inlet 55*a* is smaller than a diameter of the light outlet 56*a*. The internal surface 51*a* is a light incident surface of the reflecting device 5*a*, and is also a light emergent surface of the reflecting device 5*a*. Particularly, the internal surface 51*a* is constituted by a circle of saw-tooth structures arranged continuously. Each of the saw-tooth structures includes a first refracting surface 511*a* and a second refracting surface 512*a* which are intersected with each other. The first refracting surface 511*a* and the second refracting surface 512*a* are perpendicular to each other and are intersected with each other to generate a ridged line which may be a straight line and may also be an arc line. Two ends of each of the saw-tooth structures 510*a* extend to the first end face 53*a* and the second end face 54*a*, respectively. The external surface 52*a* is a smooth wall surface, and is also a total reflection surface. In other examples, the included angle between the first refracting surface 511*a* and the second refracting surface 512*a* may not be 90°, that is, the included angle may be smaller than or greater than 90°; and a best luminous efficiency of the reflecting device 5*a* may be obtained when the included angle of the saw-tooth structure 510*a* is 90°, in which the emergent light may be subjected to a total reflection along a direction of the incident light. An included angle of the saw-tooth structure 510*a* that is smaller than or greater than 90° may change an emergent angle of the original light which may be obtained by reflection, and hence degrade the luminous efficiency.

The reflecting device 5*a* is integrally formed from transparent plastic or glass material. The plastic material may be selected as polymethyl methacrylate (PMMA), polycarbonate (PC) and the like. A smallest thickness of the reflecting device 5*a* may be made as 2 mm, thus it can save the cost of materials and the difficulty of formation if the reflecting device 5*a* has a greater structural size.

Figure 8:
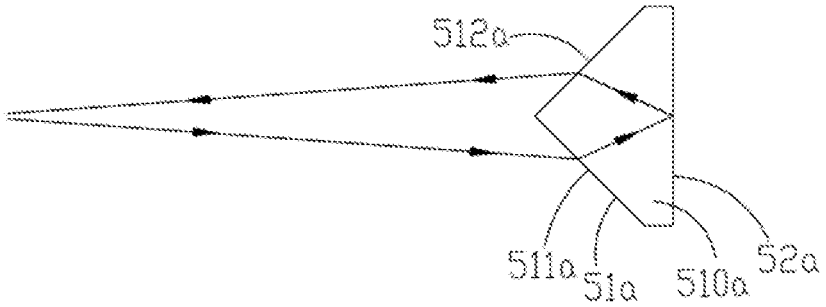
FIG. 8 is an optical path diagram of a single saw-tooth structure in a horizontal direction according to the first example of the present disclosure, by way of example.
Figure 9:
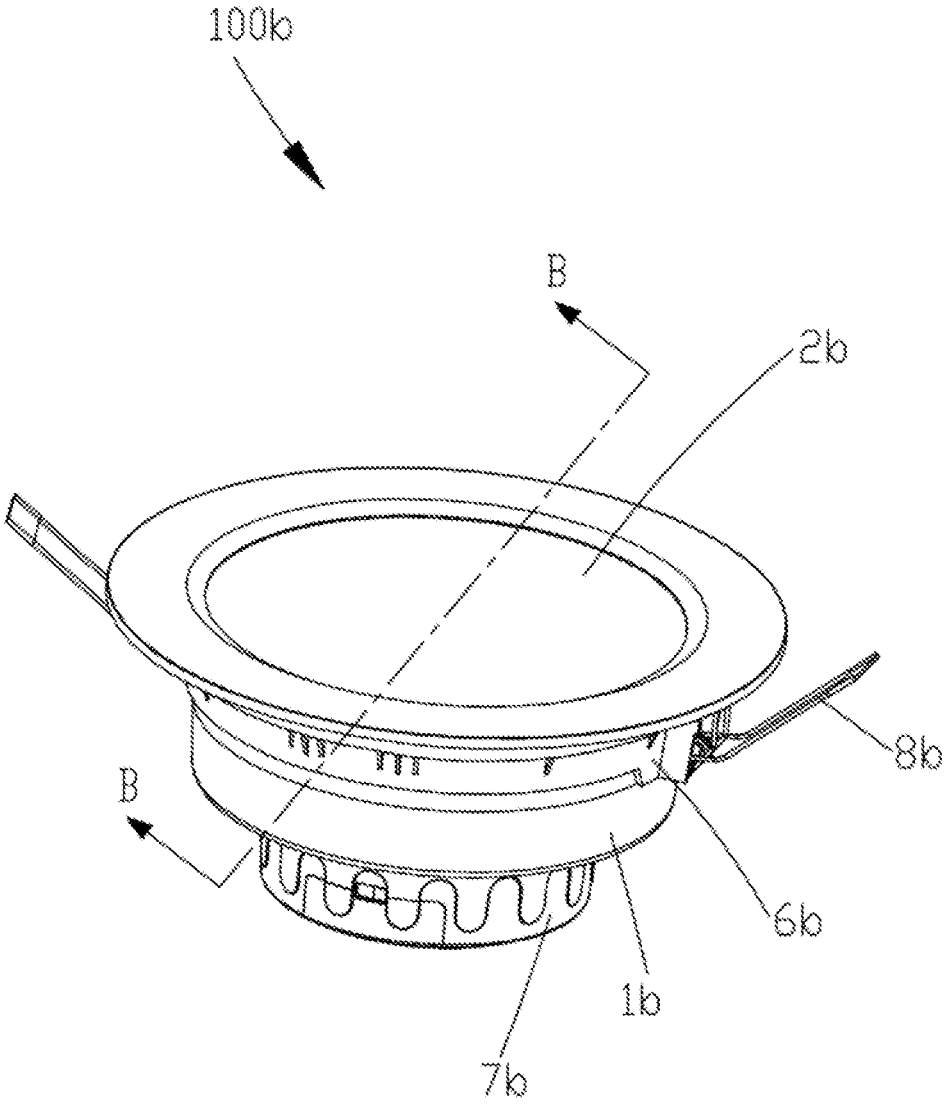
FIG. 9 is a perspective view of a lighting apparatus provided by a second example of the present disclosure.

An incident angle of light with respect to a reflecting surface can be great enough so as to realize a total reflection in a lens; otherwise the light would be transmitted through the lens. Such incident angle would be changed with the marital of the lens. In order to allow all the light that is incident into the reflecting device 5*a* to be subjected to a total reflection at the external surface 52*a*, it's necessary to design the angle of the light with respect to the external surface 52*a*. The incident angle in FIG. 8 is not enough for a total reflection, and the total reflection is achieved herein because there is also another angle in a vertical component.

Figure 6:
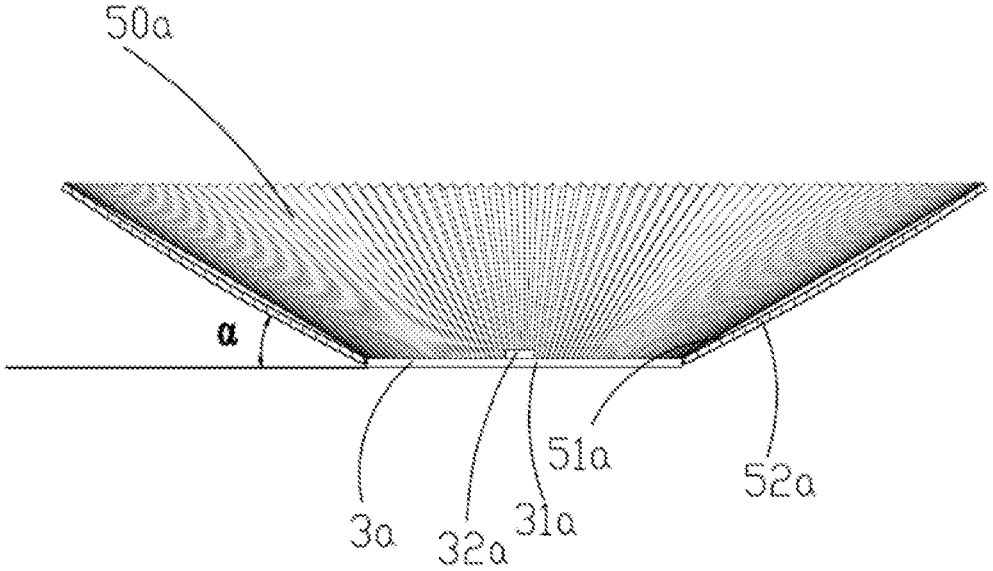
FIG. 6 is a schematic diagram illustrating an included angle between a ridged line of the reflecting device and a plane where a light source plate is located in the lighting apparatus provided by the first example of the present disclosure.
Figure 7:
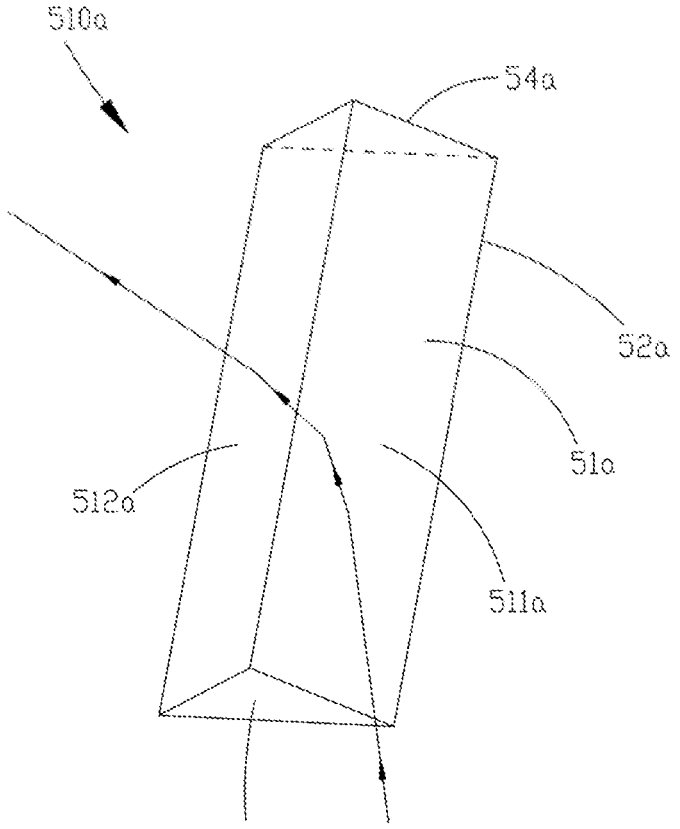
FIG. 7 is an optical path diagram of a single saw-tooth structure in a vertical direction according to the first example of the present disclosure, by way of example.

As illustrated in FIG. 5 and FIG. 6, an incident angle obtained by superimposing a horizontal component with the vertical component is great enough. For this end, the incident angle in the vertical direction has to be greater than a certain angle to achieve total reflection. The incident angle in the vertical direction is greater than a certain angle, that is, an included angle $\alpha$ between a ridged line generated by the first refracting surface 511*a* intersecting with the second refracting surface 512*a* and a plane where the light source plate 31*a* is located needs to be smaller than a certain angle A. If the light is incident at the first refracting surface 511*a* or the second refracting surface 512*a*, a refraction would be taken place, so that the incident angle of the light at the external surface would be increased; whereas, if the light is incident at the position of the ridged line, it would be most difficult to achieve a total reflection because there is barely an angle in the horizontal direction. As a result, when considering a design in which the entire reflecting wall 50*a* is a total reflection surface, the value of A is always calculated according to an optical path at the position of the ridged line. Such included angle $\alpha$ is related to the refractivity of the reflecting wall 50*a*. In the present example, if a PC material is selected, A is 38°; if a material having higher refractivity is selected, A may be 40°; and if PMMA is selected, A is 30°. For the reflecting device 5*a* in the present example, when the ridged line is an arc line, an included angle $\alpha$ between a tangent line of every point on the ridged line and the plane where the light source plate is located should satisfy the above-mentioned restricted condition, that is, the value of a is smaller than A. As a result, when the included angle $\alpha$ is smaller than the angle A (A is an angle corresponding to different materials as mentioned above) corresponding to different materials, the reflecting device 5A satisfies the condition for total reflection. In other examples where a total reflection of the lens is not necessary, it may not satisfy the condition of the included angle $\alpha$ being smaller than A, that is, any included angle in the range from 0° to 90° may be adopted. In this way, a transflective effect may be obtained on the external surface 52*a*.

Additionally, it needs to explain that, during mold designing or molding, on account of matching precision, a rounded corner would be formed at an intersecting line between the first refracting surface 511*a* and the second refracting surface 512*a* of the reflecting device 5*a*, and the light incident onto the rounded corner would be refracted and exit as stray light. The greater the rounded corner is, the smaller the central light intensity and the more the stray light will be. However, the rounded corner formed by the matching precision has little influence to the entire luminous efficiency and beam angle of the reflecting device 5*a*. Therefore, it's still believed that the reflecting device 5*a* is a total reflection lens.

Hereinafter, the optical path of the light emitted from the light-emitting unit 32*a* after the light entering the internal surface 51*a* of the reflecting device 5*a* will be described in more details.

As it can be seen from FIGS. 4-8, the light emitted from the light-emitting unit 32*a* enters the light inlet 55*a*; a part of the light is directly emitted to the optical element 2*a* through the light outlet 56*a*, and then exits through the optical element 2*a*; and another part of the light is reflected by the reflecting device 5*a*, then is emitted through the light outlet 56*a*, and finally exits through the optical element 5*a*. The particular optical path is described as below.

The light is incident onto the internal surface 51*a* of the reflecting wall 50*a*, then is refracted to the external surface 52*a* by the first refracting surface 511*a* of the saw-tooth structure 510*a* onto the internal surface 51*a*, then is totally reflected to the internal surface 51*a* by the external surface 52*a*, then is refracted into the optical space 501*a* by the internal surface 51*a*, then is emitted to the outside through the light outlet 56*a*, and finally exits through the optical element 2*a*. FIG. 8 illustrates an optical path of the light after entering the saw-tooth structure 510*a*, in which the light is totally reflected to the second refracting surface 512*a* of the internal surface 51*a* by the external surface 52*a*, and then exits. Other light (not illustrated) emitted from the light-emitting unit 32*a*, partly is reflected to the first refracting surface 511*a* of the internal surface 51*a* by the external surface 52*a* and then exits, and partly is reflected to the ridged line at the intersection between the first refracting surface 511*a* and the second refracting surface 512*a* by the external surface 52*a*, and then exits. As it can be seen in connection with FIG. 6, all of the light incident onto the reflecting wall 50*a* can be subjected to a total reflection and then exits through the internal surface 51*a* as long as the included angle $\alpha$ between the ridged line and the plane where the light source plate 31*a* is located satisfies the angle range corresponding to different materials.

The Second Example

As illustrated in FIGS. 9-12, an example of the present disclosure provides a lighting apparatus 100*b* which is a downlight lamp. Particularly, the lighting apparatus 100*b* includes a lamp body 1*b*, an optical element 2*b* connected at a frond end of the lamp body 1*b*, a connecting part 6*b* sleeved at a periphery of the lamp body 1*b*, two clamp springs 8*b* connected onto the connecting part 6*b*, a driving power source box 7*b* connected at a rear end of the lamp body 1*b*, a light source assembly 3*b* received in the lamp body 1*b*, a reflecting device 5*b* received in the lamp body 1*b* and configured to provide a secondary light distribution for the light source assembly 3*b*, and a driving power source assembly 4*b* received in the driving power source box 7*b* and electrically connected to the light source assembly 3*b*. The light source assembly 3*b* is disposed at an end of the reflecting device 5*b*. It should be explained that, the reflecting device 5*b* is in an annular shape and is transparent; the light emitted from the light source assembly 3*b*, partly exits through the optical element 2*b* directly, and partly is reflected by the reflecting device 5*b* and then exits through the optical element 2*b*.

Hereinafter, various components and connecting relationships among components in the lighting apparatus 100*b* provided by the example of the present disclosure will be described in more details.

Figure 10:
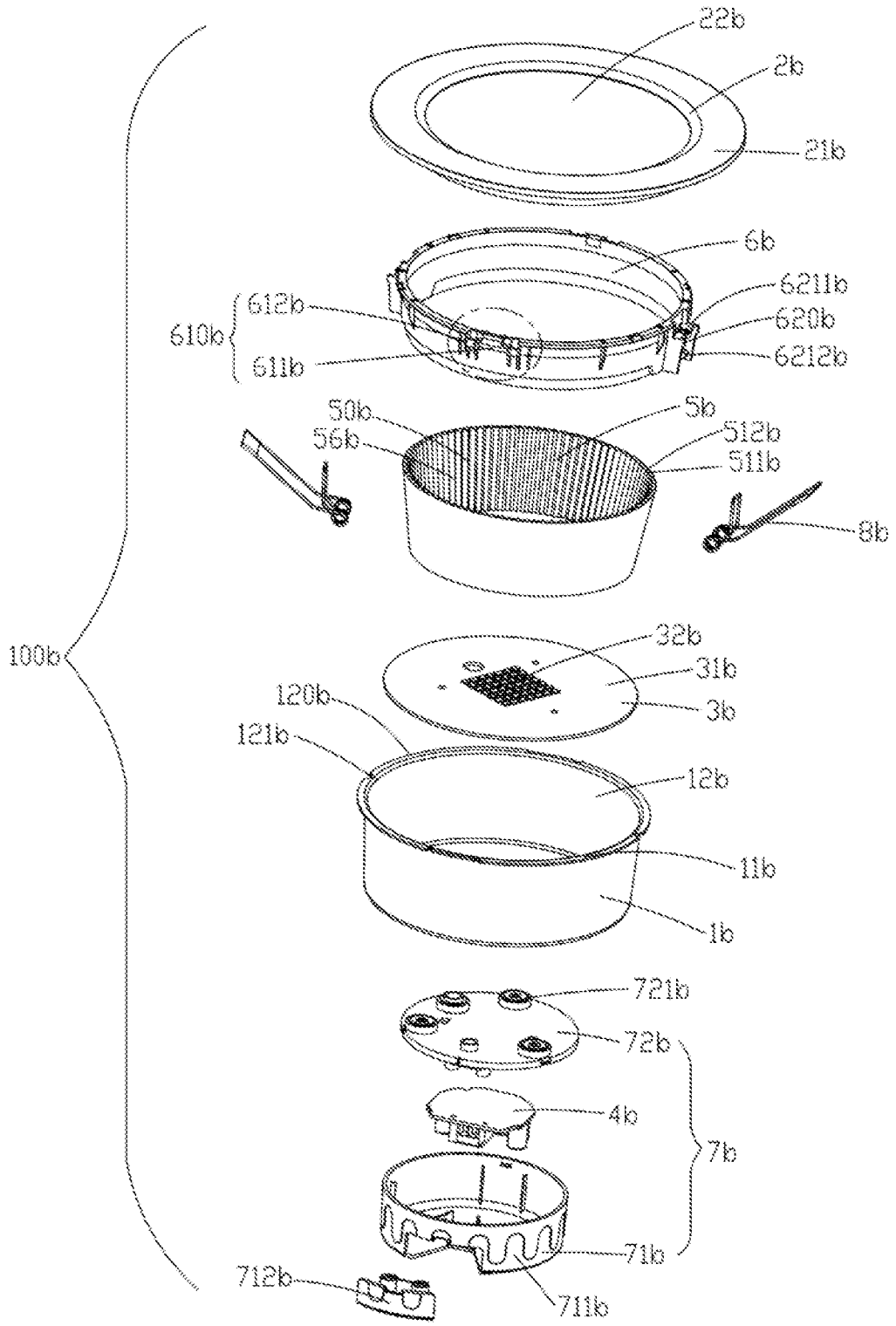
FIG. 10 is an exploded view of the lighting apparatus in FIG. 9.
Figure 11:
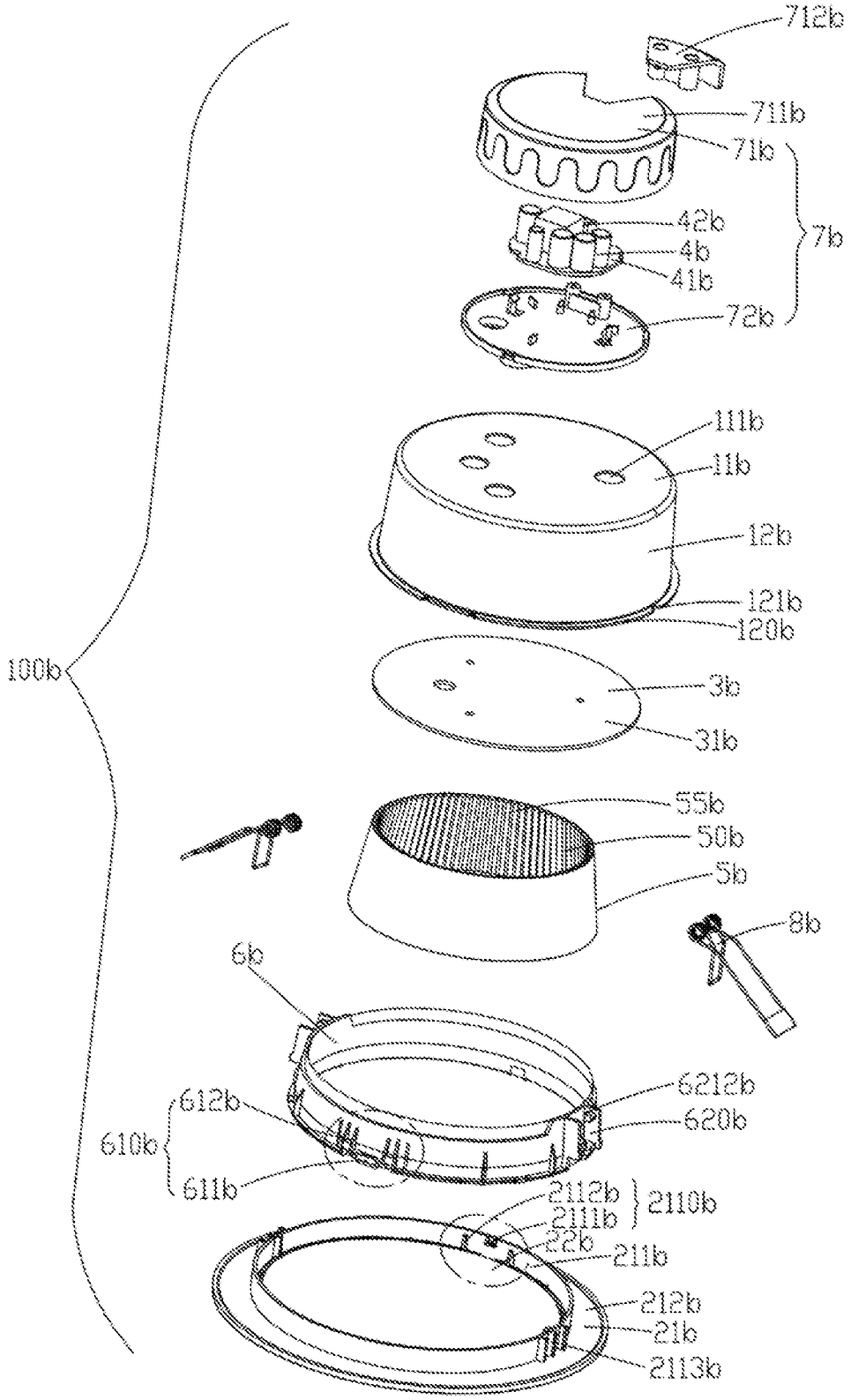
FIG. 11 is an exploded view of the lighting apparatus in FIG. 9 from another viewing angle.
Figure 12:
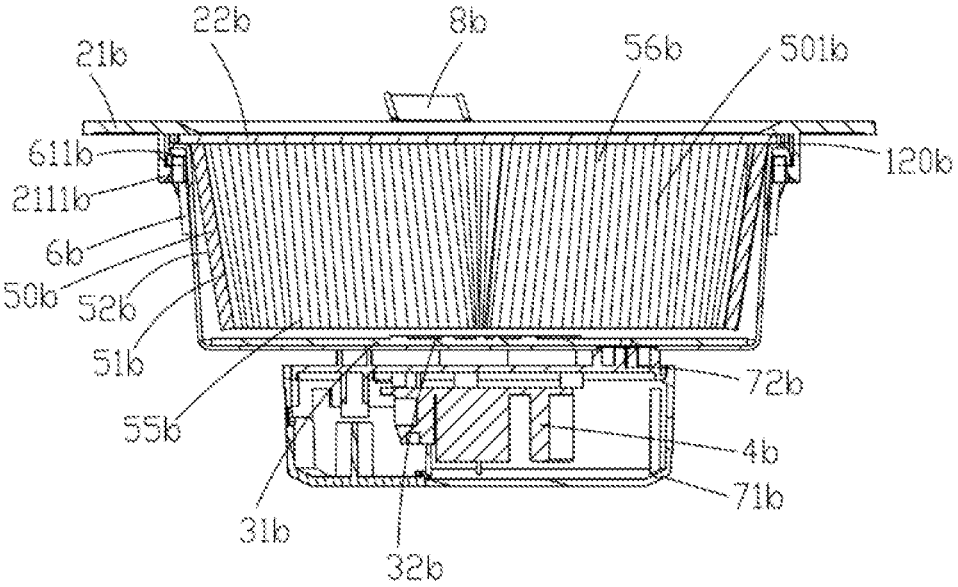
FIG. 12 is a sectional view taken along B-B line in FIG. 9.
Figure 13:
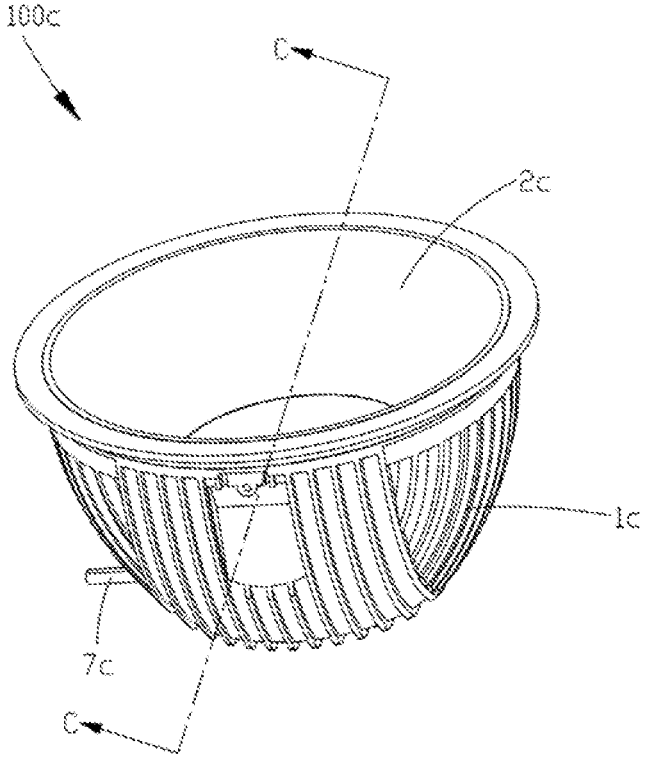
FIG. 13 is a perspective view of a lighting apparatus provided by a third example of the present disclosure.

As illustrated in FIGS. 10-12, the lamp body 1*b* is in a cylindrical shape, including a bottom wall 11*b* and a side wall 12*b*; the bottom wall 11*b* is provided with a plurality of first through holes 111*b*; an annular-shaped connecting surface 120*b* extends from an upper end of the side wall 12*b*, and is provided with a plurality of notches 121*b*. In the present example, the notch 121*b* has a semi-circular shape. The lamp body 1*b* may be made of a thermal-conductive metallic material such as Al, and may also be made of thermal-conductive plastic. As a result, the lamp body 1*b* has high thermal conductivity. When the light source assembly 3*b* located inside the lamp body 1*b* generates heat, the heat may be quickly dissipated through the lamp body 1*b*, so as to prevent from an excessively high temperature inside the lamp body 1*b* which may affect a service quality and a service life of the light source assembly 3*b*.

As illustrated in FIGS. 10-12, the optical element 2*b* plays a role of brightness balance. Particularly, the optical element 2*b* includes a surface ring 21*b* and a brightness balance plate 22*b* located at an inner side of the surface ring 21*b*. In the present example, the brightness balance plate 22*b* is disposed between the surface ring 21*b* and the reflecting device 5*b* in a manner of abutting against the surface ring 21*b* and the reflecting device 5*b*. In other alternative examples, the brightness balance plate 22*b* may be fixed inside the lighting apparatus 100*b* by using other fixing manners. The surface ring 21*b* may be made of a metallic material or plastic, including a main body 211*b* in a vertical, circular ring shape, and an annular surface 212*b* which is integrally connected with the main body 211*b* and is in a horizontal, circular ring shape. Particularly, an internal surface of the main body 211*b* is provided with a plurality of first connecting structures 2110*b*; the first connecting structure 2110*b* includes a bump 2111*b* and a fastening strip 2112*b* located at both sides of the bump 2111*b*; the fastening strip 2112*b* extends axially along the main body 211*b*. The main body 211*b* is provided with a plurality of positioning posts 2113*b*; the positioning post 2113*b* extends along an axial direction, and an end face of the positioning post 2113*b* extends beyond an end face of the main body 211*b*.

The connecting part 6*b* is in a circular ring shape, and an external side surface of the connecting part 6*b* is provided with a plurality of second connecting structures 610*b* and third connecting structures 620*b*. Particularly, the second connecting structure 610*b* includes a clamping block 611*b* and a positioning groove 612*b* located at both sides of the clamping block 611*b*; the positioning groove 612*b* extends axially along the connecting part 6*b*. The third connecting structure 620*b* includes a clamp spring mounting part 6212*b* and a connecting plate (not denoted) provided with a second through hole 6211*b*. In the present example, the first connecting structure 2110*b* is connected with the second connecting structure 610*b*, so as to realize a connection between the connecting part 6*b* and the surface ring 21*b*. Particularly, the fastening strip 2112*b* is received in the positioning groove 612*b* to realize a positioning between the connecting part 6*b* and the surface ring 21*b*; the bump 2111*b* is clamped at a lower surface of the clamping block 611*b* to be connected thereto, so as to realize a connection between the connecting part 6*b* and the surface ring 21*b*. At the same time, the lighting apparatus 100*b* of the present example further includes a screw (not illustrated), the screw passes through the second through hole 6211*b* to be received inside the positioning post 2113*b*, so as to further enhance the connection between the connecting part 6*b* and the surface ring 21*b*. Moreover, an upper face and a lower face of the connecting surface 120*b* are abutted against the surface ring 21*b* and the connecting part 6*b*, respectively; the positioning post 2113*b* is posited at an external side of the notch 121*b* so as to fix the lamp body 1*b* between the surface ring 21*b* and the connecting part 6*b*. In other alternative examples, the connecting part 6*b* may be omitted, the optical element 2*b* may be directly connected with the lamp body 16, and the clamp spring 8*b* is connected onto the optical element 2*b*.

In the present example, the clamp spring 8*b* is made of a metallic material and is clamped inside the clamp spring mounting part 6212*b*.

As illustrated in FIGS. 10-12, the driving power source box 7*b* includes a lower cover 71*b* in a housing shape, and an upper cover 72*b* in a plate shape; the lower cover 71*b* and the upper cover 72*b* are connected with each other in a snap-fit manner. An external surface of the upper cover 72*b* is provided with a plurality of connecting posts 721*b* protruded therefrom, and the connecting post 721*b* passes through the first through hole 111*b* to be connected with the light source assembly 3*b*. The lower cover 71*b* includes a first cover body 711*b* and a second cover body 712*b*; the first cover body 711*b* and the upper cover 72*b* are connected with each other in a snap-fit manner. The second cover body 712*b* and the first cover body 711*b* may be assembled with each other in a detachable manner.

The driving power source assembly 4*b* is connected onto an internal surface of the upper cover 72*b*. Particularly, the driving power source assembly 4*b* includes an annular-shaped power source plate 41*b* and a LED driving power source 42*b* located at one side of the power source plate 41*b*. In the present example, the power source plate 41*b* and the upper cover 72*b* are connected with each other in a snap-fit manner. The LED driving power source 42*b* includes a plurality of components, including but not limited to a LED driving controller chip, a rectification chip, a resistor, a capacitor, a fuse wire, a coil and the like. The lighting apparatus 100*b* of the present example further includes a power source line (not illustrated); the power source line extends into the lower cover 71*b* and is welded to the power source plate 41*b*; the power source plate 41*b* transmits an external power to the LED driving power source 42*b*, and the LED driving power source 42*b* further drives the light source assembly 3*b* to emit light. In the present example, the second cover body 712*b* and the power source plate 41*b* are fixedly connected with each other through a screw (not illustrated) so as to fixedly connect the lower cover 71*b* with the power source plate 41*b*.

In the present example, the second cover body 712*b* is inserted into the first cover body 711*b* to be connected thereto, so that the first cover body 711*b* and the second cover body 712*b* cannot be movable with each other in the up and down direction. Further, the second cover body 712*b* and the power source plate 41*b* are detachably fixed with each other through a screw (not illustrated).

As illustrated in FIGS. 10-12, the light source assembly 3*b* includes a light source plate 31*b* and a light-emitting unit 32*b* located on the light source plate 31*b*. Particularly, the light-emitting unit 32*b* is disposed at the middle part of the light source plate 31*b*, that is, disposed at the middle part of an opened side of the reflecting device 5*b*. In the present example, the light-emitting unit 32*b* is a LED light source, and a plurality of light-emitting units 32*b* is provided; these light-emitting units 32*b* are arranged on the light source plate 31*b* in an array. In other alternative examples, the driving power source assembly 4*b* may also be directly integrated onto the light source plate 31*b*; the driving power source box 7*b* may be reserved but only matched with the lamp body 1*b* in its appearance, an interior of the driving power source box 7*b* may be empty.

As illustrated in FIGS. 10-14, the reflecting device 5*b* uses a lens as the reflecting wall 50*b*, which is in an annular shape and has uniform thickness. The reflecting wall 50*b* encloses and delimits an optical space 501*b*. A structure and an optical path of the reflecting device 5*b* are similar to that of the reflecting device 5*a* in the foregoing example. Particularly, the reflecting device 5*b* includes an internal surface 51*b*, an external surface 52*b*, a light inlet 55*b* and a light outlet 56*b*; the internal surface 51*b* includes a saw-tooth structure 510*b*; the light inlet 55*b* and the light outlet 56*b* are communicated with the optical space 501*b*; the light source plate 31*b* closes the light inlet 55*b*. The difference between the reflecting device 5*b* and the reflecting device 5*a* lies in that the diameters of the light inlet and the light outlet of the two reflecting devices are different.

Moreover, in order to achieve the total reflection at the reflecting wall 50*b*, it also needs the included angle $\alpha$ formed between the ridged line generated by the first refracting surface 511*b* intersecting with the second refracting surface 512*b* and the plane where the light source 31*b* is located to be smaller than a certain angle A. In the present example, if a PC material is selected, A is 38°; if a material having higher refractivity is selected, A may be 40°; and if PMMA is selected, A is 30°.

The Third Example

As illustrated in FIGS. 13-16, an example of the present disclosure provides a lighting apparatus 100*c*, including a lamp body 1*c*, an optical element 2*c* connected at a front end of the lamp body 1*c*, a surface ring 6*c* configured to connect the lamp body 1*c* with the optical element 2*c*, a light source assembly 3*c* received in the lamp body 1*c*, a reflecting device 5*c* received in the lamp body 1*c* and configured to provide a secondary light distribution for the light source assembly 3*c*, and a brightness balance plate 4*c* covering a light outlet of the reflecting device 5*c*. The light source assembly 3*c* is disposed at one end of the reflecting device 5*c*. It should be explained that, the reflecting device 5*c* is in an annular shape and is transparent. A part of the light emitted from the light source assembly 3*c* directly exits through the brightness balance plate 4*c*; and another part of the light is reflected by the reflecting device 5*c*, then subjected to a brightness balance by the brightness balance plate 4*c*, and finally exists through the optical element 2*c*. The lighting apparatus 100*c* of the present example is a two-staged reflective downlight lamp, in which the reflecting device 5*c* is a first staged reflector and the optical element 2*c* is a second staged reflector in a form of reflex housing. The lighting apparatus 100*c* has better luminous efficiency without stray light having great angle.

Hereinafter, various components and connecting relationships among components in the lighting apparatus 100*c* provided by the example of the present disclosure will be described in more details.

As illustrated in FIGS. 13-16, the lamp body 1*c* is in a housing shape, including a bottom wall 11*c* and a side wall 12*c*; an internal surface of the side wall 12*c* is provided with a plurality of first receiving posts 121*c* and second receiving posts 122*c*. The lamp body 1*c* may be made of a thermal-conductive metallic material such as Al, and may also be made of thermal-conductive plastic; an external surface of the side wall 12*c* of the lamp body 1*c* is provided with a radiator fin. As a result, the lamp body 1*c* has high thermal conductivity. When the light source assembly 3*c* located inside the lamp body 1*c* generates heat, the heat may be quickly dissipated through the lamp body 1*c*, so as to prevent from an excessively high temperature inside the lamp body 1*c* which may affect a service quality and a service life of the light source assembly 3*c*.

As illustrated in FIGS. 13-16, the light source assembly 3*b* includes a light source plate 31*c* and a light-emitting unit 32*c* located on the light source plate 31*c*. Particularly, the light source plate 31*c* is fixed on the bottom wall 11*c* of the lamp body 1*c* through a screw (not illustrated); the light-emitting unit 32*c* is disposed at the middle part of the light source plate 31*c*, that is, disposed at the middle part of an opened side of the reflecting device 5*c*. In the present example, the light-emitting unit 32*c* is a LED light source, and a plurality of light-emitting units 32*c* is provided; these light-emitting units 32*c* are arranged on the light source plate 31*c* in a circular array. The driving power source assembly (not illustrated) is disposed outside the lamp body 1*c*, and a power supply line 7*c* connected to the driving power source assembly is connected to the light source plate 31*c* so as to further drive the light-emitting unit 32*c* to emit light.

Figure 14:
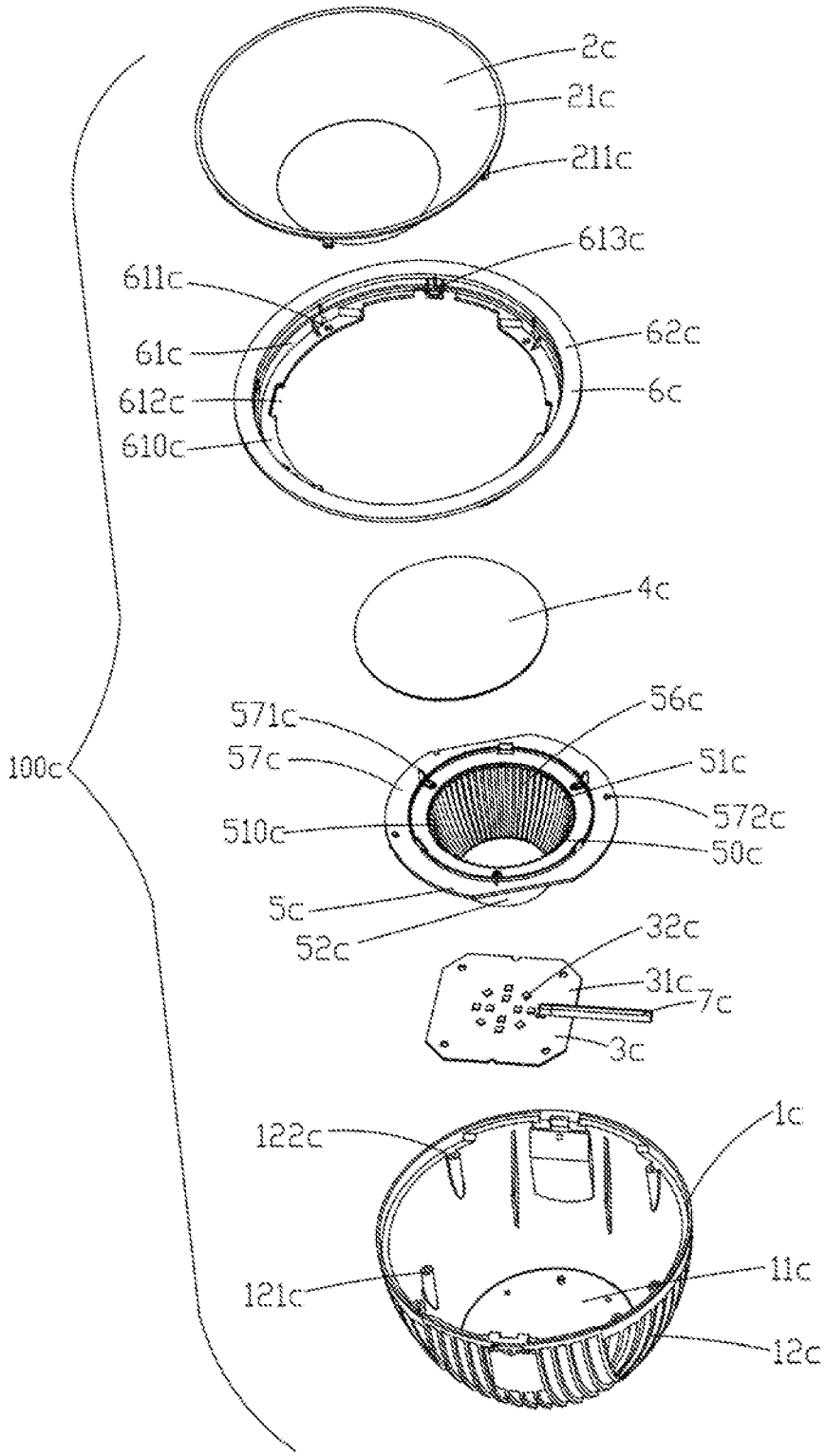
FIG. 14 is an exploded view of the lighting apparatus in FIG. 13.
Figure 15:
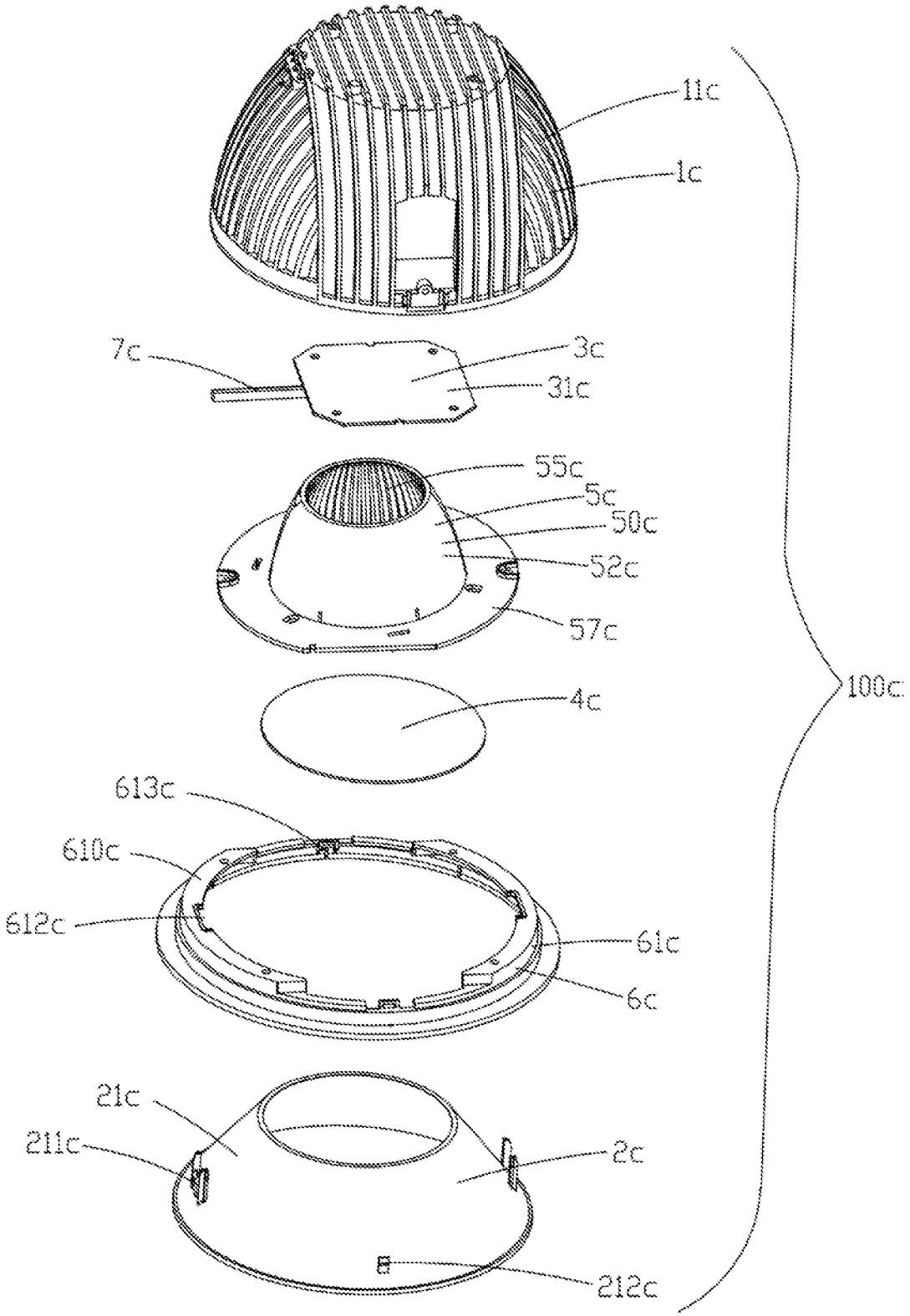
FIG. 15 is an exploded view of the lighting apparatus in FIG. 13 from another viewing angle.
Figure 16:
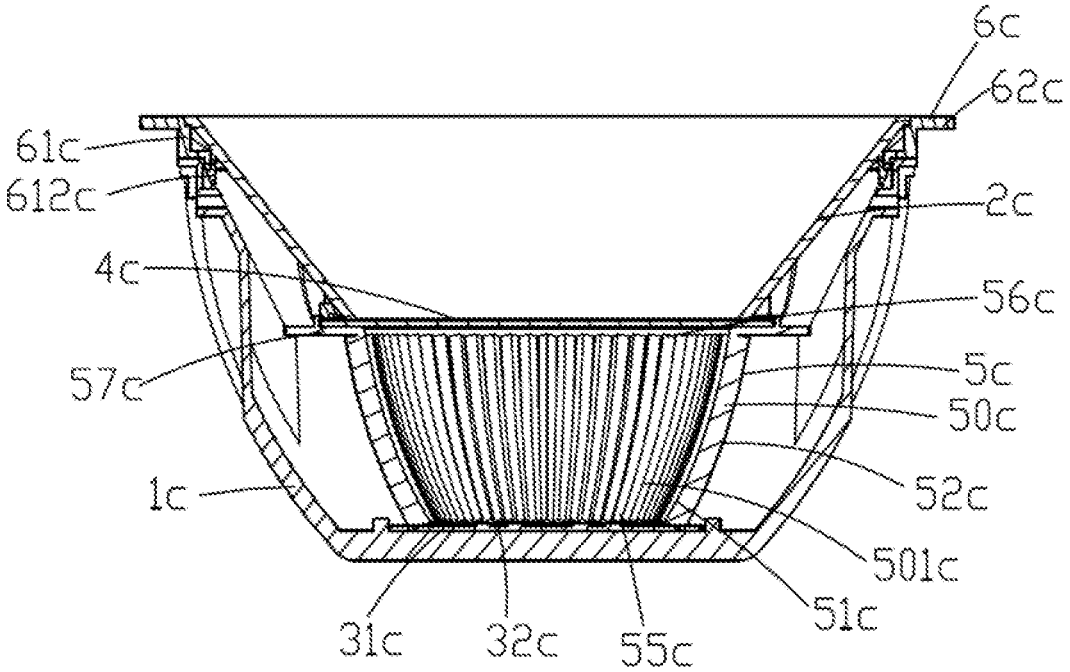
FIG. 16 is a sectional view taken along C-C line in FIG. 13.

As illustrated in FIGS. 14-16, the reflecting device 5*c* uses a lens as the reflecting wall 50*c*, which is in an annular shape and has uniform thickness. The reflecting wall 50*c* encloses and delimits an optical space 501*c*. A structure and an optical path of the reflecting device 5*c* are similar to that of the reflecting device 5*a* in the first example. Particularly, the reflecting device 5*c* includes an internal surface 51*c*, an external surface 52*c*, a light inlet 55*c* and a light outlet 56*c*; the internal surface 51*c* includes a saw-tooth structure 510*c*; the light inlet 55*c* and the light outlet 56*c* are communicated with the optical space 501*c*; the light source plate 31*c* closes the light inlet 55*c*. The difference between the reflecting device 5*c* and the reflecting device 5*a* lies in that an end of the reflecting device 5*c* provided with the light outlet 56*c* is integrally connected with a horizontal, annular surface 57*c*, and also lies in that the diameters of the light inlet and light outlet of the two reflecting devices are different. Particularly, the horizontal, annular surface 57*c* is provided with a plurality of clamping structures 571*c* protruded therefrom, and the clamping structure is configured to fix the brightness balance plate 4*c*; the annular surface 57*c* is further provided with a plurality of third through holes 572*c*, the lighting apparatus 100*c* of the present example further includes a screw (not illustrated), and a connection between the reflecting device 5*c* and the lamp body 1*c* is achieved by passing the screw through the third through hole 572*c* to be received in the first receiving post 121*c*.

In the present example, the brightness balance plate 4*c* is snap-fitted onto the reflecting device 5*c*. In other alternative examples, the brightness balance plate 4*c* may be fixed inside the lighting apparatus 100*c* by using other fixing manners.

As illustrated in FIGS. 14-16, the surface ring 6*c* may be made of a metallic material or plastic, including a main body 61*c* in a vertical, circular ring shape, and an annular surface 62*c* which is integrally connected with the main body 61*c* and is in a horizontal, circular ring shape. Particularly, the main body 61*c* extends inwardly to form a connecting plate 610*c*, and the connecting plate 610*c* is provided with a plurality of fourth through holes 611*c* penetrating the connecting plate 610*c* in the up and down direction. The lighting apparatus 100*c* of the present example further includes a screw (not illustrated), and a connection between the surface ring 6*c* and the lamp body 1*c* is achieved by passing the screw through the fourth through hole 611*c* to be received in the second receiving post 122*c*. The connecting plate 610*c* is further provided with a first clamping structure 612*c* and a second clamping structure 613*c*; the first clamping structure 612*c* is a concaved groove, while the second clamping structure 613*c* includes a clamping groove.

The optical element 2*c* is a second staged reflector in a housing shape, which is located at an inner side of the surface ring 6*c* and is connected with the surface ring 6*c*. The optical element 2*c* may play a role of light-shielding angle to remove the influence of stray light having great angle. The optical element 2*c* includes a side wall 21*c* which is electroplated or sprayed with paint, and the side wall 21*c* only plays a reflecting function. An external surface of the side wall 21*c* is provided with a plurality of first protrusion structures 211*c* and second protrusion structures 212*c*; the first protrusion structure 211*c* is connected with the first clamping structure 612*c* in a snap-fit manner, and the second protrusion structure 212*c* is connected with the second clamping structure 613*c* in a snap-fit manner so as to realize a connection between the optical element 2*c* and the surface ring 6*c*.

The Fourth Example

Figure 17:
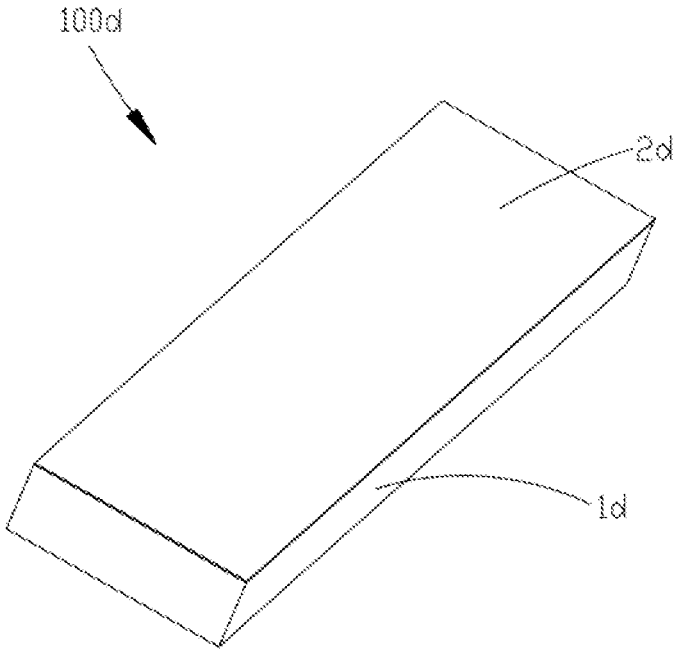
FIG. 17 is a perspective view of a lighting apparatus provided by a fourth example of the present disclosure.
Figure 18:
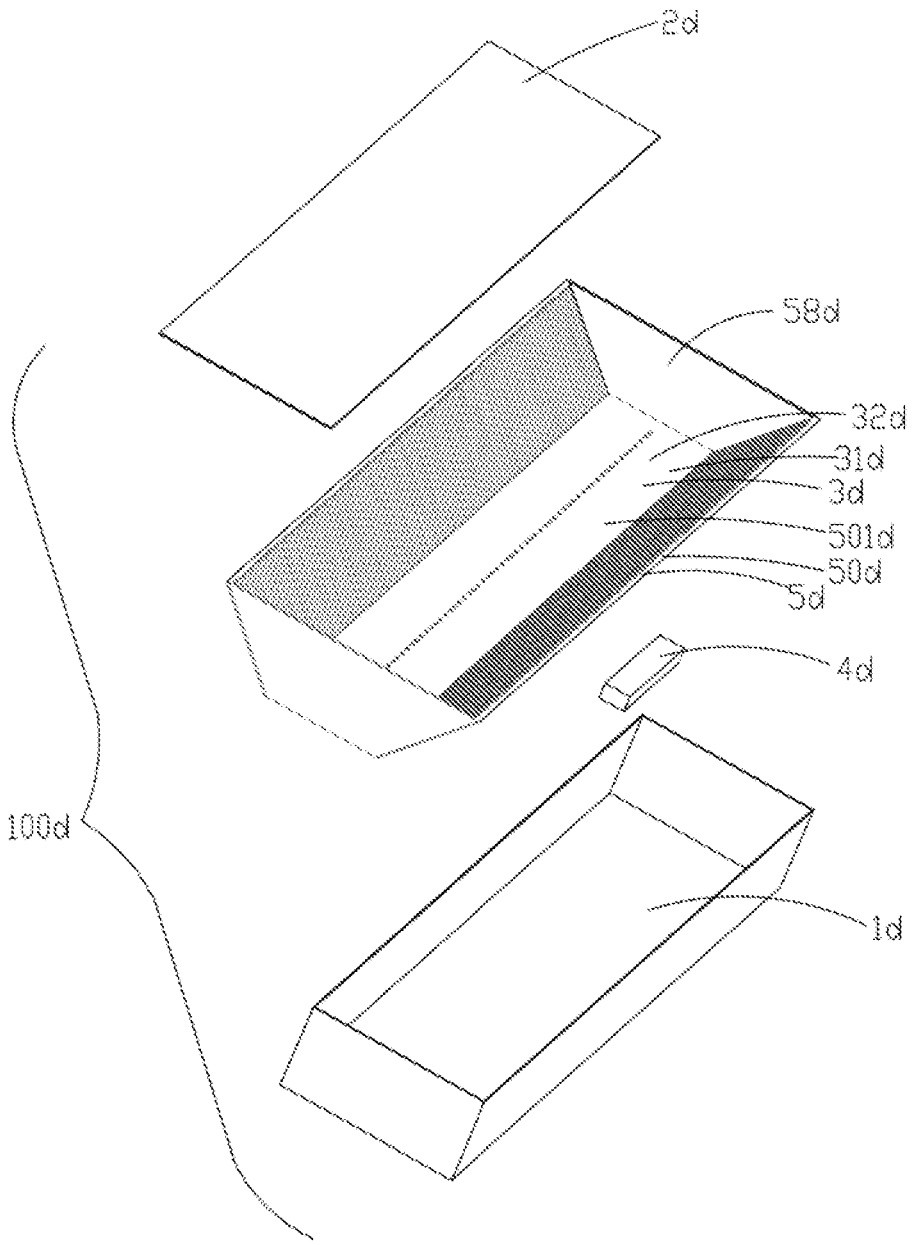
FIG. 18 is an exploded view of the lighting apparatus in FIG. 17.

As illustrated in FIGS. 17-18, the fourth example of the present disclosure provides a lighting apparatus 100*d*, the lighting apparatus 100*d* is in a rectangular shape and includes: a lamp body 1*d*, an optical element 2*d* connected with the lamp body 1*d*, a driving power source assembly 4*d* received in the lamp body 1*d*, a light source assembly 3*d* received in the lamp body 1*d*, and a reflecting device 5*d* received in the lamp body 1*d* and configured to provide a secondary light distribution for the light source assembly 3*d*. The light source assembly 3*d* is disposed at one end of the reflecting device 5*d*. It should be explained that, the light emitted from the light source assembly 3*d* partly exits through the optical element 2*d* directly, and partly is reflected by the reflecting device 5*d* and then exits through the optical element 2*d*. The lighting apparatus 100*d* may be applied in lighting fixtures such as ceiling lamp, fresh lamp and outdoor lamp.

In the present example, the reflecting device 5*d* uses two lenses disposed opposite to each other as the reflecting walls 50*d*, and a connecting plate 58*d* is disposed between the two reflecting walls 50*d*, so as to constitute a complete, reflecting device. The connecting plate 58*d*, together with the reflecting walls 50*d*, may enclose and delimit an optical space 501*d*, as illustrated in FIG. 18; the connecting plate 58*d* may also be disposed at the bottom, that is, the position of the light source assembly 3*d* in the drawings, so that the connecting plate 58*d* and the reflecting walls 50*d* may form a structure with a closed bottom and an opened top. In some other examples, the connecting plate may not be adopted, and a square-shaped or a polygonal-shaped reflecting device may be formed by using four or more reflecting walls 50*d*. It should be explained that, a part of the light emitted from the light-emitting unit 32*d* is refracted, reflected and then refracted again by the reflecting wall 50*d*, then is directly emitted through the internal surface 51*d* of the reflecting wall 50*d*, and then exits through the light outlet; and another part of the light is reflected by the connecting plate 58*d* and is emitted through the internal surface (not labeled) of the connecting plate 58*d*, and then exits through the light outlet.

A structure and an optical path of the reflecting wall 50*d* are similar to that of the reflecting wall 50*a* of the reflecting device 5*a* in the first example, with the only difference that the reflecting wall 50*d* is in a plate shape while the reflecting wall 50*a* is in an annular shape. The ridged line of the reflecting wall 50*d* may be a straight line, and may also be an arc line.

The connecting plate 58*d* is also in a flat plate shape. The connecting plate 58*d* has two sides attached onto the side surface of the reflecting wall 50*d*, and has upper and lower end faces flush with upper and lower end faces of the reflecting wall 50*d*, respectively, so as to enclose the light-emitting unit 32*d* in the optical space 501*d* constituted by the reflecting wall 50*d* and the connecting plate 58*d*. An internal surface of the connecting plate 58*d* is a total reflection surface. In order to form the total reflection surface, the connecting plate 58*d* may be made of a material having a total reflection function such as plastic and metal; the total reflection surface may also be achieved by a surface treatment such as surface finishing process and plating process.

To sum up, in the lighting apparatus provided by the examples of the present disclosure, a lens is used as a reflecting device, an external surface of the reflecting device includes a plurality of saw-tooth structures arranged continuously, an internal surface of the reflecting device is used as a light incident surface and a light emergent surface at the same time, and the external surface includes a first reflecting surface and a second reflecting surface; with such design, all the light incident onto the internal surface can exit with an optical effect of total reflection, so as to improve the luminous efficiency without the need of an electroplating process.

The present disclosure provides a lighting apparatus with relatively higher luminous efficiency.

The present disclosure provides a lighting apparatus, including a lamp body, an optical element connected with the lamp body, a light source assembly received in the lamp body, a reflecting device received in the lamp body and configured to provide a secondary light distribution for the light source assembly, and a driving power source assembly received in the lamp body and electrically connected with the light source assembly; the reflecting device is provided with a light inlet, a light outlet and a reflecting wall located between the light inlet and the light outlet; the reflecting wall is transparent, and the reflecting wall includes an internal surface and an external surface;

the internal surface includes a plurality of saw-tooth structures arranged continuously; each of the saw-tooth structures includes a first refracting surface and a second refracting surface intersected with each other; two ends of each of the saw-tooth structures extend towards the light inlet and the light outlet, respectively, the light source assembly is disposed at the light inlet of the reflecting device.

Further, the reflecting device is in an annular shape, and the reflecting device has uniform thickness.

Further, the first refracting surface and the second refracting surface are perpendicular to each other.

Further, the external surface of the reflecting wall is a smooth wall and is also a total reflection wall.

Further, a diameter of the light inlet is smaller than a diameter of the light outlet, and the two ends of the saw-tooth structure extend into at least one of the light inlet and the light outlet.

Further, the first refracting surface and the second refracting surface of the saw-tooth structure are intersected with each other to generate a ridged line, and the ridged line is a straight line or an arc line.

Further, an included angle between a tangent line of any point on the ridged line and a plane where the light inlet is located is smaller than A, wherein A is 40°.

Further, if a material of the reflecting wall is PC, A equals to 38°; and if the material of the reflecting wall is acrylic, A equals to 30°.

Further, two reflecting walls opposite to each other are provided, and each of the reflecting walls is in a flat plate shape.

Further, the reflecting device further includes a connecting plate disposed between the reflecting walls.

Further, the lighting apparatus further includes a heat sink received in the lamp body, and both of the light source assembly and the driving power source assembly are received in the heat sink.

Further, an upper end face and a lower end face of the heat sink, and/or, an upper surface and a lower surface of the heat sink, are disposed between the optical element and the lamp body in a manner of abutting against the optical element and the lamp body, respectively.

Further, the light source assembly and the driving power source assembly are disposed integrally or disposed separately.

Further, the light source assembly and the driving power source assembly are disposed separately; the driving power source assembly includes an annular-shaped power source plate and a driving power source located at one side of the power source plate; and the light source assembly is located at an inner side of the power source plate.

Further, the light source assembly includes a light source plate and a plurality of light-emitting units located on the light source plate.

Further, the lighting apparatus further includes a connecting part sleeved at a periphery of the lamp body, and the connecting part is connected with the lamp body and the optical element, respectively.

Further, the optical element includes a surface ring and a brightness balance plate located at an inner side of the surface ring.

Further, the surface ring includes a main body in a vertical, circular ring shape, and an annular surface which is connected integrally with the main body and is in a horizontal, circular ring shape; the main body is connected with the lamp body and the optical element, respectively.

Further, the lighting apparatus further includes two clamp springs which are connected at an external side of the connecting part.

Further, the lighting apparatus further includes a driving power source box connected with the lamp body, and the driving power source assembly is received in the driving power source box.

Further, the lighting apparatus includes a first staged reflector and a second staged reflector; the reflecting device is the first staged reflector, and the optical element is the second staged reflector which is in a form of reflex housing.

Further, the lighting apparatus further includes a brightness balance plate, the brightness balance plate covers the light outlet of the reflecting device, and the reflex housing is located above the brightness balance plate.

Further, the optical element includes a surface ring located at an external side of the reflex housing, and the surface ring is connected with the lamp body.

Further, an optical space is enclosed and delimited by the light inlet, the light outlet and the internal surface of the reflecting device; a part of light emitted from the light source assembly enters the reflecting wall upon being refracted by the internal surface, enters the optical space upon being reflected by the reflecting wall, and exits through the light outlet; and another part of the light emitted from the light source assembly directly passes through the optical space and exits through the light outlet.

Beneficial effects: as compared to the other technology, in the lighting apparatus provided by the examples of the present disclosure, the internal surface of the reflecting device includes a plurality of saw-tooth structures arranged continuously, the internal surface is used as a light incident surface and a light emergent surface at the same time, and the external surface is used as a reflecting surface; with such design, all the light incident onto the internal surface can exit with an optical effect of total reflection, so as to improve the luminous efficiency without the need of an electroplating process.

The present disclosure also provides a method of manufacturing a lighting apparatus. The method may include providing a lamp body; connecting an optical element the lamp body; receiving a light source assembly in the lamp body; receiving a reflecting device in the lamp body, wherein the reflecting device is configured to provide: a light distribution for the light source assembly, and a driving power source assembly received in the lamp body and electrically connected with the light source assembly.

The method may also include providing the reflecting device with a light inlet, a light outlet and a reflecting wall located between the light inlet and the light outlet, wherein the reflecting wall is transparent, and the reflecting wall comprises an internal surface and an external surface, where the internal surface may include a plurality of saw-tooth structures arranged continuously, each of the saw-tooth structures may include a first refracting surface and a second refracting surface intersected with each other, and two ends of each of the saw-tooth structures extend towards the light inlet and the light outlet; and disposing the light source assembly at the light inlet of the reflecting device.

The method may further include providing a connecting part sleeved at a periphery of the lamp body and connecting the connecting part the lamp body and the optical element.

The present disclosure may include dedicated hardware implementations such as application specific integrated circuits, programmable logic arrays and other hardware devices. The hardware implementations can be constructed to implement one or more of the methods described herein. Applications that may include the apparatus and systems of various examples can broadly include a variety of electronic and computing systems. One or more examples described herein may implement functions using two or more specific interconnected hardware modules or devices with related control and data signals that can be communicated between and through the modules, or as portions of an application-specific integrated circuit. Accordingly, the system disclosed may encompass software, firmware, and hardware implementations. The terms "module," "sub-module," "circuit," "sub-circuit," "circuitry," "sub-circuitry," "unit," or "sub-unit" may include memory (shared, dedicated, or group) that stores code or instructions that can be executed by one or more processors. The module refers herein may include one or more circuit with or without stored code or instructions. The module or circuit may include one or more components that are connected.

The foregoing particular examples further describe the objects, technical solutions and advantages of the present disclosure in more details. It should be appreciated that, the above merely are particular examples of the present disclosure, but not limitative to the present disclosure. Any modification, equivalent replacement, improvement and the like that is made within the spirit and principle of the present disclosure shall be within the protection scope of the present disclosure.

What is claimed is:

1. A lighting apparatus, comprising a lamp body, an optical element connected with the lamp body, a light source assembly received in the lamp body, a reflecting device received in the lamp body and configured to provide a light distribution for the light source assembly, and a driving power source assembly received in the lamp body and electrically connected with the light source assembly; and wherein:

the reflecting device is provided with a light inlet, a light outlet and a reflecting wall located between the light inlet and the light outlet, the reflecting wall is transparent, and the reflecting wall comprises an internal surface and an external surface;

the internal surface comprises a plurality of saw-tooth structures arranged continuously, each of the saw-tooth structures comprises a first refracting surface and a second refracting surface intersected with each other, and two ends of each of the saw-tooth structures extend towards the light inlet and the light outlet;

the light source assembly is disposed at the light inlet of the reflecting device;

the first refracting surface and the second refracting surface of the saw-tooth structure are intersected with each other to generate a ridged line; and an included angle between a tangent line of any point on the ridged line and a plane where the light inlet is located is smaller than A, wherein A is 40°.

2. The lighting apparatus according to claim 1, wherein the reflecting device is in an annular shape, and the reflecting device has uniform thickness.

3. The lighting apparatus according to claim 1, wherein the first refracting surface and the second refracting surface are perpendicular to each other.

4. The lighting apparatus according to claim 1, wherein the external surface of the reflecting wall is a smooth wall and is a total reflection wall.

5. The lighting apparatus according to claim 1, wherein a diameter of the light inlet is smaller than a diameter of the light outlet, and the two ends of the saw-tooth structure extend into at least one of the light inlet and the light outlet.

6. The lighting apparatus according to claim 1, wherein, when a material of the reflecting wall is polycarbonate, A equals to 38°; and when the material of the reflecting wall is acrylic, A equals to 30°.

7. The lighting apparatus according to claim 1, wherein two reflecting walls opposite to each other are provided, and each of the reflecting walls is in a flat plate shape.

8. The lighting apparatus according to claim 7, wherein the reflecting device further comprises a connecting plate disposed between the reflecting walls.

9. The lighting apparatus according to claim 1, wherein the lighting apparatus further comprises a heat sink received in the lamp body, and both of the light source assembly and the driving power source assembly are received in the heat sink.

10. The lighting apparatus according to claim 9, wherein an upper end face and a lower end face of the heat sink, and/or, an upper surface and a lower surface of the heat sink, are disposed between the optical element and the lamp body in a manner of abutting against the optical element and the lamp body.

11. The lighting apparatus according to claim 1, wherein the light source assembly and the driving power source assembly are disposed integrally or disposed separately.

12. The lighting apparatus according to claim 1, wherein:

the driving power source assembly and the light source assembly are disposed separately;

the driving power source assembly comprises an annular-shaped power source plate and a driving power source located at one side of the power source plate; and the light source assembly is located at an inner side of the power source plate.

13. The lighting apparatus according to claim 1, wherein:

the lighting apparatus comprises a first staged reflector and a second staged reflector; and the reflecting device is the first staged reflector, and the optical element is the second staged reflector in a form of reflex housing.

14. The lighting apparatus according to claim 1, wherein the lighting apparatus further comprises a connecting part sleeved at a periphery of the lamp body, and the connecting part is connected with the lamp body and the optical element.

15. The lighting apparatus according to claim 14, wherein the optical element comprises a surface ring and a brightness balance plate located at an inner side of the surface ring.

16. The lighting apparatus according to claim 15, wherein the surface ring comprises a main body in a vertical, circular ring shape, and an annular surface which is connected integrally with the main body and is in a horizontal, circular ring shape;

the main body is connected with the lamp body and the optical element.

17. A method of manufacturing a lighting apparatus, comprising:

providing a lamp body;

connecting an optical element with the lamp body;

receiving a light source assembly in the lamp body;

receiving a reflecting device in the lamp body, wherein the reflecting device is configured to provide: a light distribution for the light source assembly, and a driving power source assembly received in the lamp body and electrically connected with the light source assembly;

providing the reflecting device with a light inlet, a light outlet and a reflecting wall located between the light inlet and the light outlet, wherein the reflecting wall is transparent, and the reflecting wall comprises an internal surface and an external surface, wherein the internal surface comprises a plurality of saw-tooth structures arranged continuously, each of the saw-tooth structures comprises a first refracting surface and a second refracting surface intersected with each other, and two ends of each of the saw-tooth structures extend towards the light inlet and the light outlet; and disposing the light source assembly at the light inlet of the reflecting device, wherein the first refracting surface and the second refracting surface of the saw-tooth structure are intersected with each other to generate a ridged line, and an included angle between a tangent line of any point on the ridged line and a plane where the light inlet is located is smaller than 40°.

18. The method according to claim 17, further comprising:

providing a connecting part sleeved at a periphery of the lamp body and connecting the connecting part with the lamp body and the optical element.

* * * * *